US007061479B2

(12) United States Patent
Kawasaki et al.

(10) Patent No.: US 7,061,479 B2
(45) Date of Patent: Jun. 13, 2006

(54) PLASMA DISPLAY PANEL AND METHOD OF DRIVING THE SAME

(75) Inventors: Tatsuhiko Kawasaki, Kawasaki (JP); Takashi Sasaki, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 11/140,972

(22) Filed: Jun. 1, 2005

(65) Prior Publication Data

US 2005/0225511 A1 Oct. 13, 2005

Related U.S. Application Data

(62) Division of application No. 10/377,598, filed on Mar. 4, 2003, now Pat. No. 6,924,795.

(30) Foreign Application Priority Data

Mar. 15, 2002 (JP) ..... 2002-72648

(51) Int. Cl.
*H01J 11/02* (2006.01)

(52) U.S. Cl. ..... 345/204; 345/30; 345/37; 345/77; 313/582; 313/585; 315/169.4

(58) Field of Classification Search ..... 345/30, 345/37, 41, 60, 77, 204, 205, 206; 313/582, 313/584, 585, 586, 587; 315/169.4
See application file for complete search history.

(56) References Cited

U.S. PATENT DOCUMENTS

| | | | | |
|---|---|---|---|---|
| 4,130,779 | A * | 12/1978 | Miller et al. | 345/58 |
| 5,446,344 | A * | 8/1995 | Kanazawa | 315/169.4 |
| 5,663,741 | A * | 9/1997 | Kanazawa | 345/66 |
| 5,986,724 | A * | 11/1999 | Akiyama et al. | 349/41 |
| 6,084,349 | A * | 7/2000 | Ueoka et al. | 313/587 |
| 6,104,361 | A * | 8/2000 | Rutherford | 345/55 |
| 6,448,946 | B1 * | 9/2002 | Anderson et al. | 345/60 |
| 6,924,795 | B1 * | 8/2005 | Kawasaki et al. | 345/204 |
| 2001/0040435 | A1 | 11/2001 | Park et al. | 315/160 |

FOREIGN PATENT DOCUMENTS

JP HEI 9(1997) 160525 6/1997

* cited by examiner

*Primary Examiner*—Vijay Shankar
*Assistant Examiner*—Vincent E. Kovalick
(74) *Attorney, Agent, or Firm*—Staas & Halsey LLP

(57) ABSTRACT

A driving method of the present invention is adapted to a plasma display panel which includes first and second electrodes formed on a substrate, third electrodes formed in a direction intersecting the first and second electrodes, and a dielectric layer covering the first and second electrodes. The driving method includes the steps of generating an address discharge between the first and the third electrode to select a predetermined cell and sustain discharges between the first and the second electrode to produce light for display, and controlling the plasma display panel such that the discharge intensity of a sustain discharge in which the second electrode serves as the anode is smaller than the discharge intensity of a sustain discharge in which the first electrode serves as the anode.

5 Claims, 15 Drawing Sheets

(a) DISCHARGE WHERE Y ELECTRODE SERVES AS ANODE (b) DISCHARGE WHERE X ELECTRODE SERVES AS ANODE

LIGHT EMISSION PROFILE
DRIVING WAVEFORM OF Y (SCAN) ELECTRODE
DRIVING WAVEFORM OF X (SUSTAIN) ELECTRODE
Vs(Y)
Vs(X)
Vs(X)<Vs(Y)

LIGHT EMISSION PROFILE
DRIVING WAVEFORM OF Y (SCAN) ELECTRODE
DRIVING WAVEFORM OF X (SUSTAIN) ELECTRODE
Vs(Y)
Vs(X)
Vs(X)=Vs(Y)=Vso

FIG. 15 (a1)
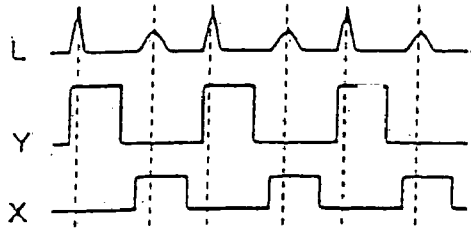
FIG. 15 (a2)
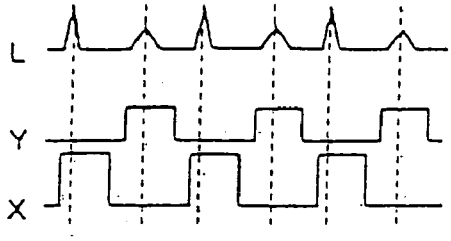
FIG. 15 (b1)
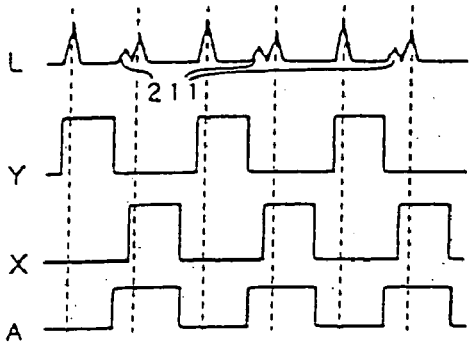
FIG. 15 (b2)
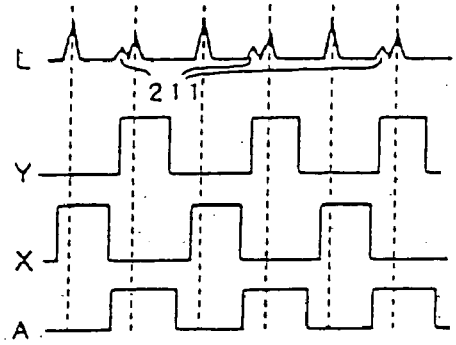
FIG. 15 (c1)
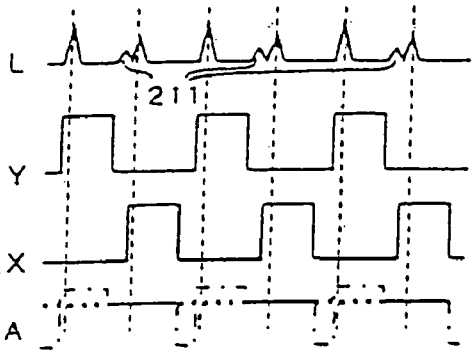
FIG. 15 (c2)
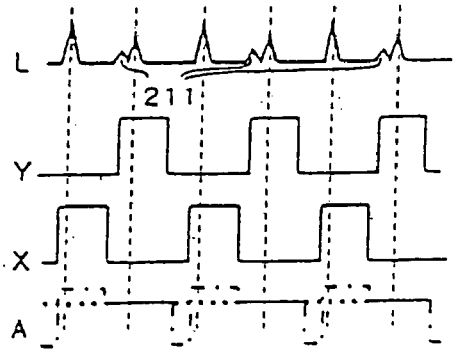
FIG. 15 (d1)
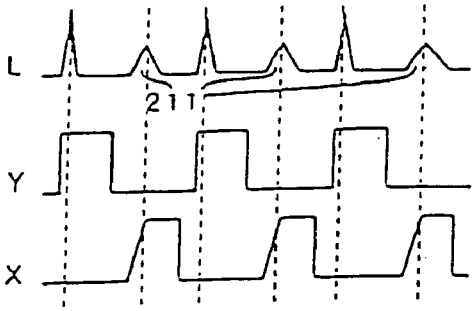
FIG. 15 (d2)
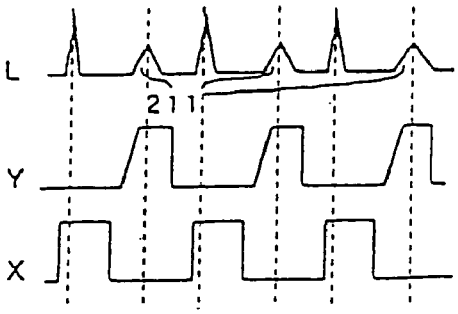

PLASMA DISPLAY PANEL AND METHOD OF DRIVING THE SAME

CROSS-REFERENCE TO RELATED APPLICATION

This application is a divisional of application Ser. No. 10/377,598, filed Mar. 4, 2003, now U.S. Pat. No. 6,924,795.

This application is related to Japanese application JP2002-072648, filed on Mar. 15, 2002, whose priority is claimed under 35 USC § 119, the disclosure of which is incorporated by reference in its entirety.

BACKGROUND OF THE INVENTION

1. Field of the Invention

The present invention relates to a plasma display panel and a method of driving it. More particularly, it relates to a plasma display panel adapted to reduce deterioration in operating margin of a plasma display panel device, the deterioration being caused with time by variations with time in characteristics of a protective layer surface of the plasma display panel, and to a method of driving the plasma display panel.

2. Description of the Related Art

Conventionally, plasma display panels as gas discharge display devices have been used for display terminals on the TV, computer or like. Recently, a number of producers and universities have actively conducted research and development on the use of plasma display panels for the information display terminal or the wall-mount TV. With significant progress of information-oriented society, plasma display panel devices, as digital display devices, have been expected to serve as the multi-media monitor as well.

Referring to FIG. 10, the structure of a plasma display panel (hereafter referred to as a PDP) will be explained. FIG. 10 is an exploded view schematically illustrating the structure of a pixel of the PDP in perspective. A front substrate 10 has two display electrodes 11 and 12 arranged substantially in parallel. These display electrodes 11 and 12 are provided in this order in a large number over the entire surface of the front substrate 10. The display electrodes 11 and 12, also referred to as sustain display electrodes, typically comprise transparent electrodes 11*i* and 12*i* as well as bus electrodes 11*b* and 12*b* formed thereon, respectively. The substrate 10 has also a dielectric layer 13 covering these electrodes 11 and 12, as well as a protective layer 14 formed on the dielectric layer 13. The protective layer 14 is mainly made of MgO. Typically, the thickness of the front substrate 10 is about 2–3 mm, the thickness of the dielectric layer 13 is several tens μm, and the thickness of the protective layer 14 is about 1 μm.

A rear substrate 20, on the other hand, has address electrodes 21 in a direction intersecting the sustain electrodes 11 and 12, and are covered with a dielectric layer 23. Barrier ribs 25 are provided between the address electrodes 21. Phosphor layers 26R (red), 26G (green) and 26B (blue) are each formed between the barrier ribs on the upper surface of the dielectric layer 23 and the side walls of the barrier rib. Shown in FIG. 10 is only one set of phosphor layers 26R, 26G and 26B, though actually provided are a plurality of sets of phosphor layers 26R, 26G and 26B in a number corresponding to the number of pixels of the PDP. Typically, the height of the barrier rib is 100–200 μm.

FIG. 11 shows a block diagram of the construction of a plasma display panel device (hereafter referred to as a PDP device) that includes a circuit for driving the PDP. The sustain electrodes 11 and 12 shown in FIG. 10 are referred to as X and Y electrodes, respectively, which are indicated by Xi (i=1, 2, 3 . . . ) and Yj (j=1, 2, 3 . . . ), respectively, in FIG. 11. The X electrodes are driven by an X sustain circuit 101, and the Y electrodes are driven by a Y scan driver 112 and by a Y sustain circuit 111, in FIG. 11. The address electrodes 21 shown in FIG. 10 are indicated by Ak (k=1, 2, 3 . . . ) and driven by an address driver 121 in FIG. 11.

The lit (ON) or unlit (OFF) state of each cell is selected between the address electrode Ak and the Y electrode Yj. A cell set to the ON state emits light by a sustain discharge for display of a color image. Sustain discharges are carried out between the X electrode and the Y electrode with driving waveforms of voltages applied over the entire display screen.

Now, the driving waveforms and the constitution of a frame will be explained with reference to FIGS. 12(*a*)–12(*c*) and 13, respectively.

As shown in FIGS. 12(*a*), 12(*b*) and 12(*c*), the driving waveform is basically comprised of a reset period, an address period and a sustain period. In each period, the waveforms as shown are applied to the X electrode, the Y electrode and the address electrode. Initialization is carried out in the reset period, desired cells are selected in the address period, and sustain discharges for display are generated in the sustain period.

As shown in FIG. 13, each of a plurality of frames constituting one image consists of n sub-frames that correspond to the respective weights of display luminances. Each sub-frame is comprised of the three periods (the reset period, the address period and the sustain period) as shown in FIGS. 12(*a*), 12(*b*) and 12(*c*).

Driving the PDP using both the driving waveforms and the constitution of the frame as shown in FIGS. 12(*a*)–12(*c*) and 13 allows performance of gradation display of color image.

To prolong the life of the PDP device with improved stability, it is necessary to reduce deterioration in operating margin of the PDP device, the deterioration being caused with time by "variations with time in performance characteristics".

Examination on causes of the "variations with time in performance characteristics" has indicated that one cause is "variations in performance characteristics of the address discharge". The "variations in characteristics of the address discharge" arises from "variations in characteristics (characteristics) of a surface of the protective layer 14" described as follows.

Two kinds of discharge mode within a cell of the PDP give rise to such "variations with time in performance characteristics". First, these two kinds of discharge mode will be explained with reference to FIG. 14. (In FIG. 14, the X electrode 11 is shown as one electrode by combining together the transparent electrode 11*i* and the bus electrode 11*b*, and the same holds for the Y electrode 12 in FIG. 14.)

Of the two kinds of discharge mode, one is a sustain discharge mode indicated by reference numeral 201 in FIG. 14, and the other is an address discharge mode indicated by reference numeral 202.

The sustain discharge 201 is an AC discharge of alternate polarities, which occurs between the X electrode 11 and the Y electrode 12. The sustain discharge 201, as is clear from FIG. 14, is a "surface discharge", which occurs over a surface of one substrate (the surface of the protective layer 14).

The address discharge 202, on the other hand, is what is known as a kind of DC discharge, typically of a single polarity, which occurs between the address electrode 21 and the Y electrode 12. The address discharge 202 is an "opposite discharge", which occurs between two substrates.

Next, "variations with time in performance characteristics" relevant to the present invention will be explained.

Ions generated during the sustain discharge 201 collide against the surface of the protective layer 14 disposed on both the X electrode and the Y electrode, thereby gradually sputtering the protective layer 14. Substances thus produced by such sputtering, trace amounts of impurities present in a discharge gas or the like may adhere to the surface of the protective layer 14. Such sputtering of ions, adhesion of impurities or the like are attributed to variations in characteristics of the surface of the protective layer 14 (in characteristics of secondary electron emission yield γ and the like).

Thus, the sustain discharge 201 causes the "variations in performance characteristics of the surface of the protective layer 14", which in turn vary performance characteristics of the address discharge 202. This is because the address discharge 202 is a DC discharge in which typically, the address electrode 21 serves as the anode and the Y electrode 12 serves as the cathode. Variations in characteristics of a portion of the surface of the protective layer 14 on the cathode (especially, in characteristics of secondary electron emission yield γ and the like) cause variations in characteristics of the address discharge 202.

After a long-term use of the PDP, a voltage in the address discharge 202 may either rise or lower depending on the driving method or the driving waveform of the address discharge 202. In any case, however, the voltage varies with time from an initial voltage. Variations in characteristics (variations in characteristics between cells) that a PDP originally has; difference in frequency of use between cells depending on the manner of the screen display; or the like, increase variations in characteristics of the surface of the protective layer 14 (especially of secondary electron emission yield γ and the like), thereby widening "variations in characteristics (variations in voltage) of the address discharge 202". "Variations in characteristics (variations in voltage) of the address discharge 202" lead to gradual deterioration in operating margin of the PDP device.

Thus, a "mechanism of deterioration with time" has been clarified as follows: The sustain discharge 201 (the surface discharge) causes gradual and long-term variations in "characteristics of the surface of the protective layer 14", which lead to "variations in characteristics of the address discharge 202 (opposite discharge)", with the result of especially deteriorating "operating margin of the address discharge 202". Deterioration in operating margin finally shortens the life of the PDP device.

Variations in characteristics of the surface of the protective layer 14 cause variations in both the characteristics of the sustain discharge 201 and those of the address discharge 202, though it has been found that ordinarily, the variation ratio is larger in the address discharge 202. To prolong the life of the PDP device, therefore, it is especially important to reduce variations in characteristics of the address discharge 202.

SUMMARY OF THE INVENTION

The present invention has been made in view of the above circumstances, and an object of the present invention is to provide a plasma display panel adapted to reduce "deterioration in operating margin of a plasma display panel device", the deterioration being caused with time by "variations with time in characteristics of a protective layer 14 surface of the plasma display panel", as well as a method of driving the plasma display panel.

To achieve the above-mentioned object, a first group of inventions according to the present application decrease the amount, to be sputtered during the sustain discharge (the surface discharge), of the portion of the protective layer on the Y electrode (the portion of the protective layer covering the Y electrode), the portion of the protective layer being straightforwardly involved in the address discharge, or reduce variations in characteristics of the address discharge (the opposite discharge) through improvement in the structure of the PDP.

To achieve the aforementioned object, a second group of inventions according to the present application drive the PDP such that the sustain discharges have at least two discharge intensity values and the discharge intensity values are changed periodically. Driving the plasma display panel in such a manner causes decrease of the amount, to be sputtered during the sustain discharge (the surface discharge), of the portion of the protective layer on the Y electrode, the portion of the protective layer being straightforwardly involved in the address discharge, for reducing variations in characteristics of the address discharge (the opposite discharge).

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIGS. 15(*a*1), 15(*a*2), 15(*b*1), 15(*b*2), 15(*c*1), 15(*c*2), 15(*d*1), 15(*d*2) show driving waveforms according to Embodiment 8.

DESCRIPTION OF THE PREFERRED EMBODIMENTS

The first and second groups of the present invention are as follows.

A first invention of the first group provides a method of driving a plasma display panel which includes a plurality of first electrodes formed on a substrate, a plurality of second electrodes formed between adjacent first electrodes, a plurality of third electrodes formed in a direction intersecting the first electrodes and the second electrodes, and a dielectric layer covering the first electrodes and the second electrodes and having a protective layer on a surface of the dielectric layer, the method comprising: generating an address discharge between the first electrode and the third electrode to select a predetermined cell and sustain discharges between the first electrode and the second electrode to produce light for display; and controlling the plasma display panel such that the discharge intensity of a sustain discharge in which the second electrode serves as the anode is smaller than the discharge intensity of a sustain discharge in which the first electrode serves as the anode.

The protective layer is sputtered by the collision therewith of positive ions present in the discharge gas. This means that the sustain discharge in which the second electrode (the X electrode) serves as the anode cause sputtering of the portion of the protective layer on the first electrode (the Y electrode) serving as the cathode. For this reason, the peak value of the discharge intensity (the instantaneous discharge intensity) of the sustain discharge in which the second electrode (the X electrode) serves as the anode is lowered to ease the damage to be caused to the portion of the protective layer on the first electrode (the Y electrode), thereby reducing variations in characteristics of the address discharge (the opposite discharge) between the scan electrode and the address electrode.

Figure 1:
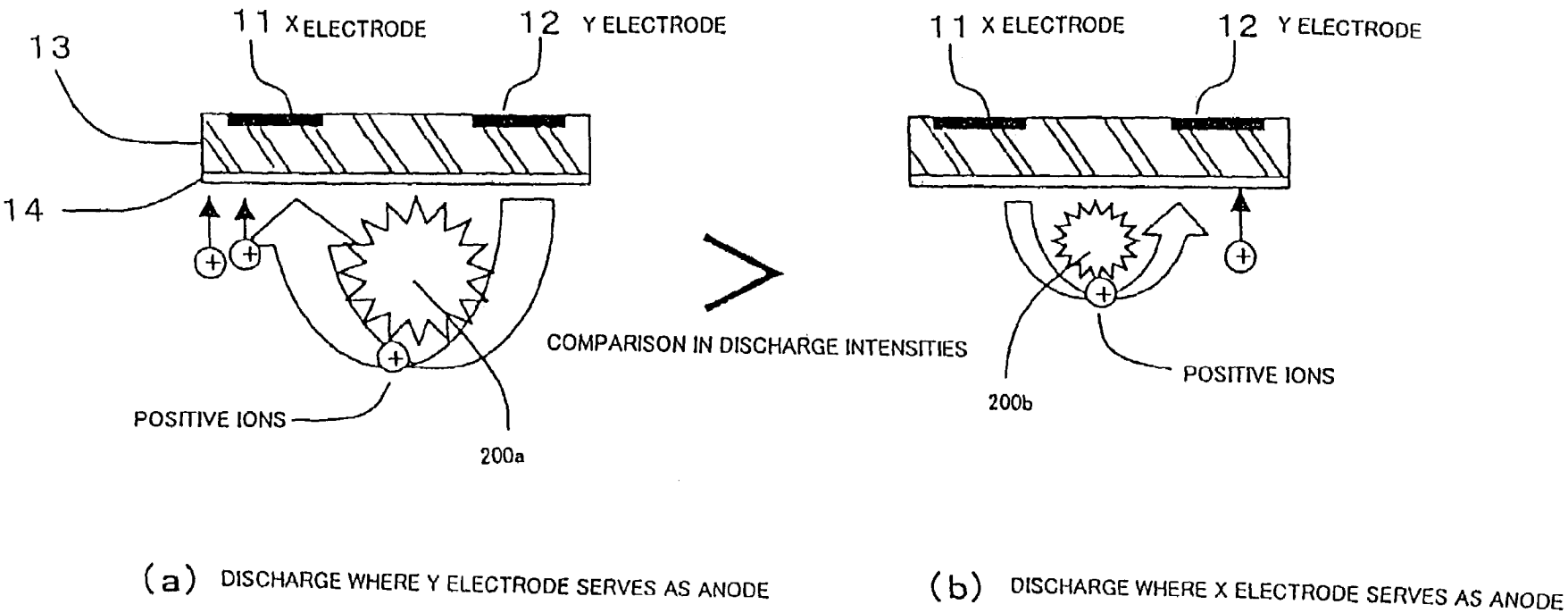
FIGS. 1(*a*) and 1(*b*) are views illustrating examples of the discharge intensities of a PDP according to the present invention.

Referring to FIGS. 1(*a*)–1(*b*) and 2(*a*)–2(*b*), explanations will be given on the above-mentioned discharge intensities.

Figure 10:
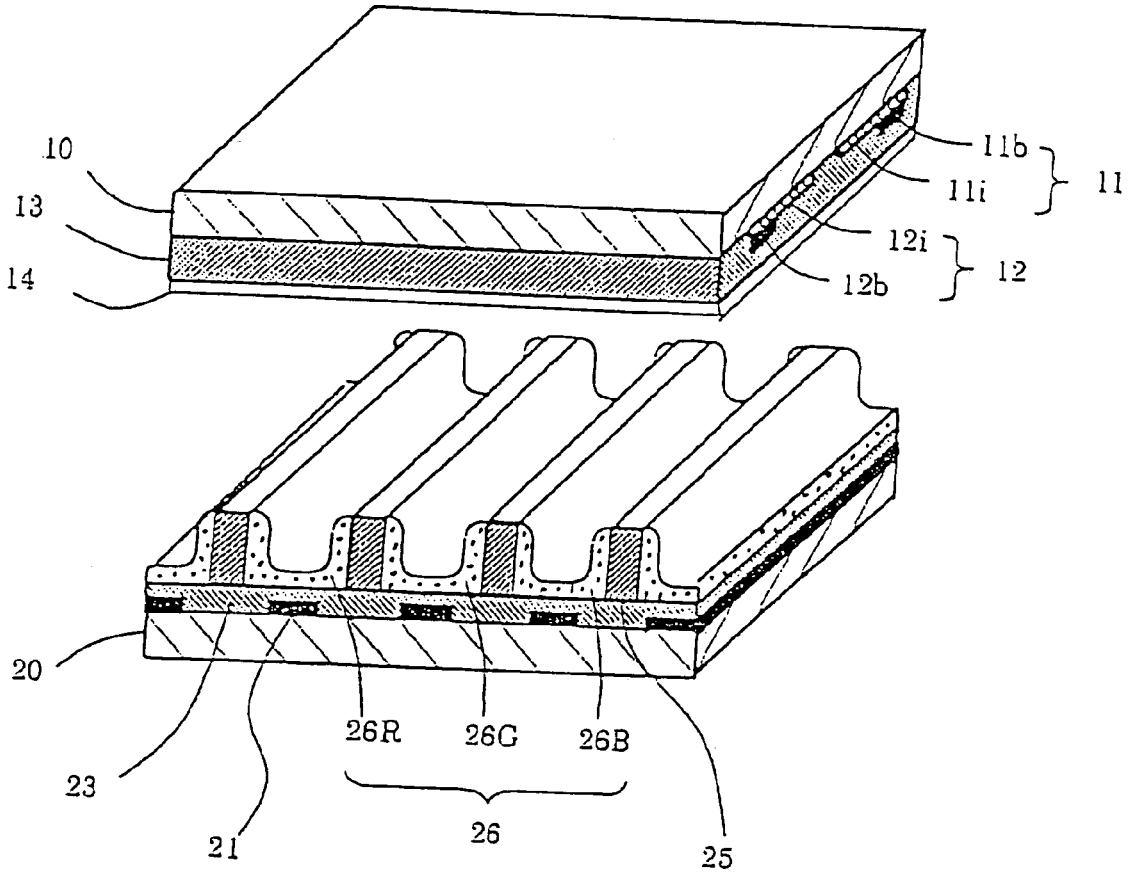
FIG. 10 is an exploded view schematically illustrating the structure of a PDP.

In these drawings, illustrations are omitted of a rear substrate as shown in FIG. 10 and of elements formed thereon, as well as of a front substrate. Also, the X electrode 11 is shown as one electrode by combining together the transparent electrode 11*i* and the bus electrode 11*b* shown in FIG. 10, as well as the Y electrode 12 by combining together the transparent electrode 12*i* and the bus electrode 12*b*.

Figure 2:
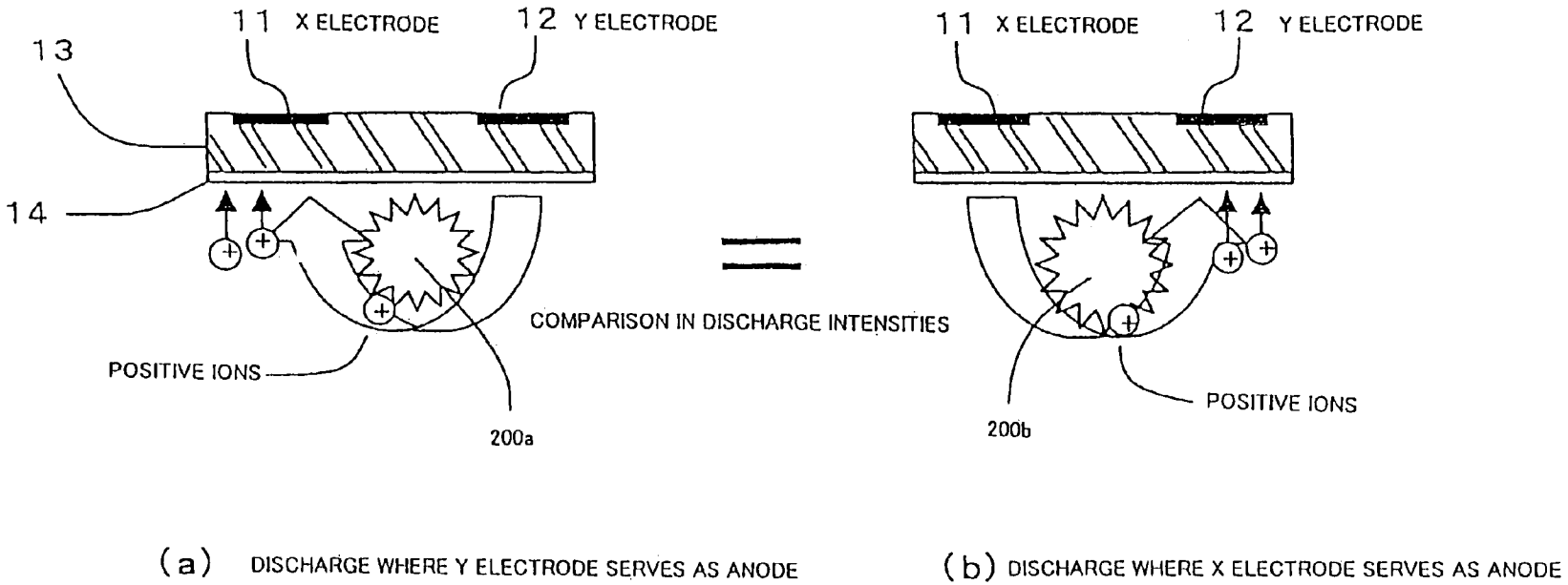
FIGS. 2(*a*) and 2(*b*) are views illustrating examples of the discharge intensities of a conventional PDP.

As in FIGS. 2(*a*) and 2(*b*), conventionally, a sustain discharge 200*a* in which the Y electrode 12 serves as the anode and a sustain discharge 200*b* in which the X electrode 11 serves as the anode has the same discharge intensity, and therefore, incur the same degree of damage from the positive ions' collision. In the present invention, on the other hand, the sustain discharge 200*b* in which the X electrode serves as the anode has a smaller discharge intensity than that of the sustain discharge 200*a* in which the Y electrode serves as the anode, as shown in FIGS. 1(*a*) and 1(*b*). Therefore, the sustain discharge 200*b* in which the X electrode serves as the anode, incurs a smaller damage from the positive ions' collision. Thus, it is possible to ease the damage to the portion of the protective layer 14 on the Y electrode 12, thereby reducing variations in characteristics of the address discharge (the opposite discharge) between the scan electrode and the address electrode.

In a second invention of the first group, the driving pulses of the sustain discharges are set such that the crest value of the sustain discharge in which the second electrode (the X electrode) serves as the anode is smaller than that of the sustain discharge in which the first electrode (the Y electrode) serves as the anode. By thus driving the plasma display panel, it is possible to lower the discharge intensity of the sustain discharge in which the X electrode serves as the anode (i.e., the Y electrode serves as the cathode), thereby also reducing variations in characteristics of the address discharge in which the Y electrode serves as the cathode and in which the address electrode serves as the anode.

In a third invention of the first group, an auxiliary discharge is generated after the sustain discharge in which the first electrode (the Y electrode) serves as the anode and prior to the sustain discharge in which the second electrode (the X electrode) serves as the anode. Generating the auxiliary discharge makes it possible to weaken the discharge intensity of the subsequent sustain discharge. Ordinarily, the electric currents of the auxiliary discharge and the subsequent sustain discharge would amount in total to the electric current of a single sustain discharge as originally scheduled. Dividing the single sustain discharge into the two makes it possible to decrease the peak value of the discharge intensity (the instantaneous discharge intensity). As a result, energy of positive ions to collide against the protective layer 14 would be lessened to reduce the damage to the protective layer 14.

In a fourth invention of the first group, the driving pulse obtained when the second electrode (the X electrode) serves as the anode has a longer rise-time than that of the driving pulse obtained when the first electrode (the Y electrode) serves as the anode. When the pulse having a longer rise-time is used as the pulse of a sustain discharge, it is possible to lower the discharge intensity of the sustain discharge. Therefore, when the pulse having a longer rise-time is used as the driving pulse of the sustain discharge in which the second electrode (the X electrode) serves as the anode, it is possible to ease the damage to the portion of the protective layer 14 on, the first electrode (the Y electrode), thereby reducing variations in characteristics of the address discharge as in the above-mentioned case.

A fifth invention of the first group provides a plasma display panel wherein the sustain electrode (the X electrode) has a smaller area than that of the scan electrode (the Y electrode).

When the scan electrode (the Y electrode) that can serve as the cathode in the sustain discharge is increased in area, it is possible to scatter the discharge current accordingly, thereby decreasing the peak value of the discharge intensity (the instantaneous discharge intensity) per unit area of the protective layer. As a result, it is possible to ease the damage to be caused to the portion of the protective layer on the scan electrode, thereby reducing variations in characteristics of the address discharge.

A sixth invention of the first group provides a plasma display panel wherein a portion of the dielectric layer covering the scan electrode (the Y electrode) is thicker than a portion of the dielectric layer covering the sustain electrode (the X electrode). This makes it possible to provide a wider electric field distribution in the thicker portion of the dielectric layer covering the scan electrode (the Y electrode), thereby reducing the amount of an electric current per unit area. Also, the wall voltage, generated by adhesion of positive ions to the dielectric layer, becomes higher at the thicker portion with increase of the thickness thereof, so that the subsequent positive ions collide against the surface of the protective layer at attenuated velocity to ease the damage thereto. This results in reduction of variations with time in characteristics of the address discharge.

A first invention of the second group provides a method of driving a plasma display panel which includes a plurality of first electrodes formed on a substrate, a plurality of second electrodes formed between adjacent first electrodes, a plurality of third electrodes formed in a direction intersecting the first electrodes and the second electrodes, and a dielectric layer covering the first electrodes and the second electrodes and having a protective layer on a surface of the dielectric layer, the method comprising: generating sustain discharges between the first electrode and the second electrode to produce light for display; controlling the plasma display panel such that the sustain discharges have at least two discharge intensity values given depending on whether the first electrode serves either as the cathode or as the anode; and periodically changing said at least two discharge values given depending on whether the first electrode serves either as the cathode or as the anode at predetermined intervals.

By thus driving the PDP such that the sustain discharges have at least two discharge intensity values and that said at least two discharge intensity values are changed periodically, it is possible to ease the damage to the protective layer in general.

It is found that, when the instantaneous discharge intensity of a sustain discharge is decreased below a predetermined value, the damage to the protective layer is significantly eased. Therefore, the damage to the protective layer can generally be eased by driving the PDP such that the sustain discharges have at least two discharge intensity values and that said at least two discharge intensity values are changed periodically.

Though having a smaller effect in easing the damage than that of the inventions of the first group, the inventions of the second group are advantageous in that the damage to the protective layer surface can be even between the portion thereof on the X electrode and the portion on the Y electrode.

According to a driving method according to a first invention of the second group, at least two discharge intensity values are changed which are obtained by the driving method of a second invention or a third invention of the first group. The driving method of the first invention of the second group is specifically realized by a second invention or a third invention of the second group.

The present invention will now be explained in detail based on the preferred embodiment shown in the drawings. It should be understood that the present invention is not limited to the embodiments.

Embodiments

Embodiment 1

Figure 3:
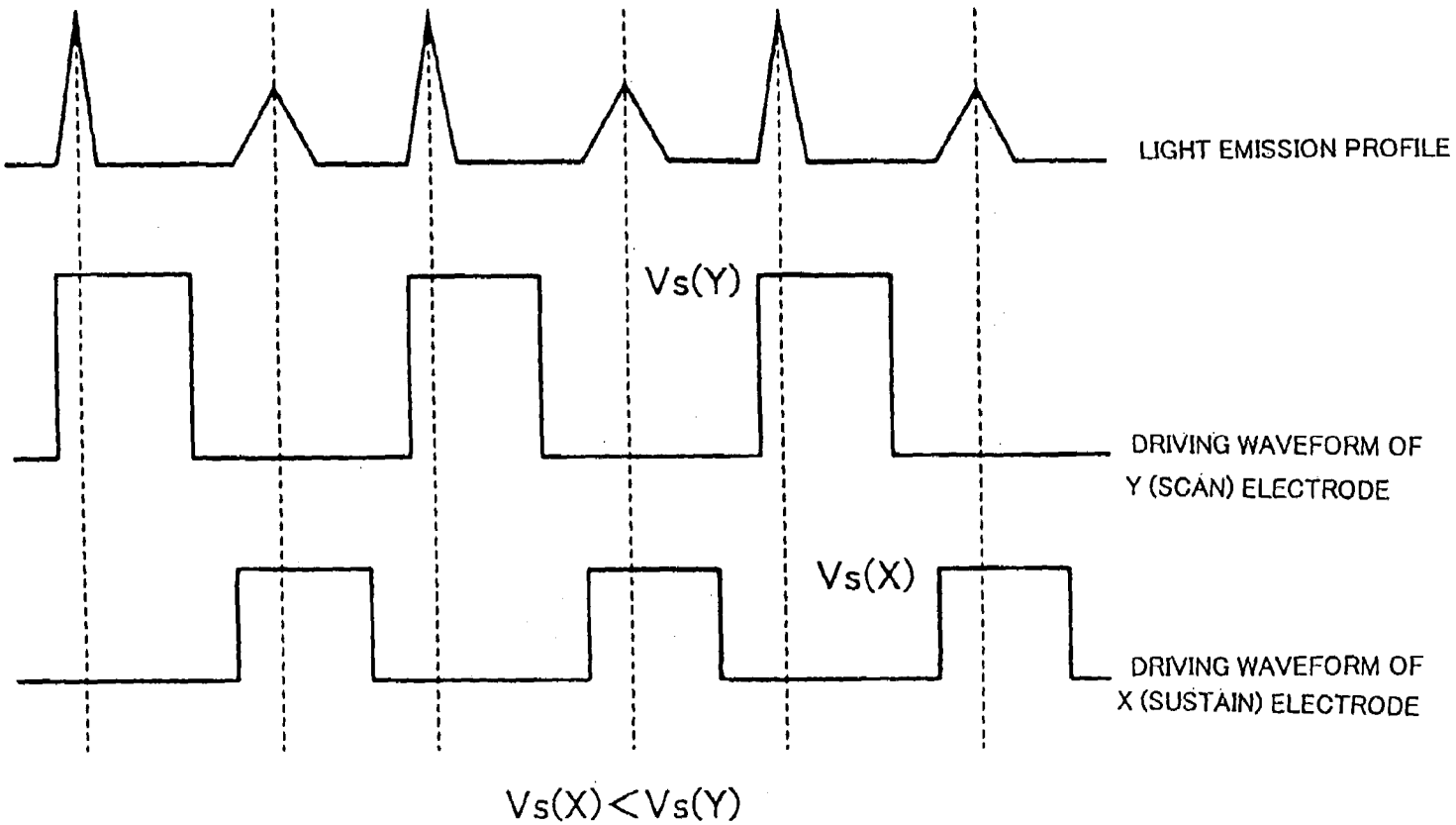
FIGS. 3(*a*), 3(*b*) and 3(*c*) illustrate driving waveforms according to Embodiment 1.

Referring to FIGS. 3(*a*), 3(*b*) and 3(*c*), a driving method according to Embodiment 1 will be explained.

FIGS. 3(*a*) and 3(*b*) show driving waveforms of voltages applied to the X electrode and the Y electrode, respectively, for generating sustain discharges.

In a sustain discharge of a PDP, a discharge intensity becomes larger with the increase of a sustain voltage. For this reason, by reducing a sustain voltage (i.e., a crest value of a sustain pulse) Vs(X) applied to the sustain electrode (the X electrode) to a smaller value than that of a sustain voltage (i.e., a crest value of a sustain pulse) Vs(Y) applied to the scan electrode (the Y electrode), it is possible to reduce the instantaneous discharge intensity of a sustain discharge in which the sustain electrode serves as the anode to a smaller value than the value of the instantaneous discharge intensity of a sustain discharge in which the scan electrode serves as the anode. As a result, it is possible to ease the damage to be caused to the portion of the protective layer on the scan electrode, thereby reducing variations in characteristics of the address discharge (the opposite discharge) between the scan electrode and the address electrode.

FIG. 3(*c*) shows the light emission profile of this case. The peak values, of pulses, in this light emission profile correspond to the instantaneous discharge intensities (or the peak values of a discharge current). As shown, the peak values great and small in the light emission profile correspond to the values great and small of the sustain voltage.

If simply, only the sustain voltage Vs(X) applied to the sustain electrode (the X electrode) is lowered, brightness of panel is reduced accordingly. Thus, though there is achieved an object of the present invention, i.e., reduction in deterioration with time in operating margin of the address discharge, panel brightness is reduced. Against this drawback, the sustain voltage Vs(Y) applied to the scan electrode (the Y electrode) is increased to a higher value than conventionally, in compensation for lowering the sustain voltage Vs(X) applied to the sustain electrode (the X electrode), so as to achieve the object of the present invention without reducing average brightness of the entire panel.

Figure 4:
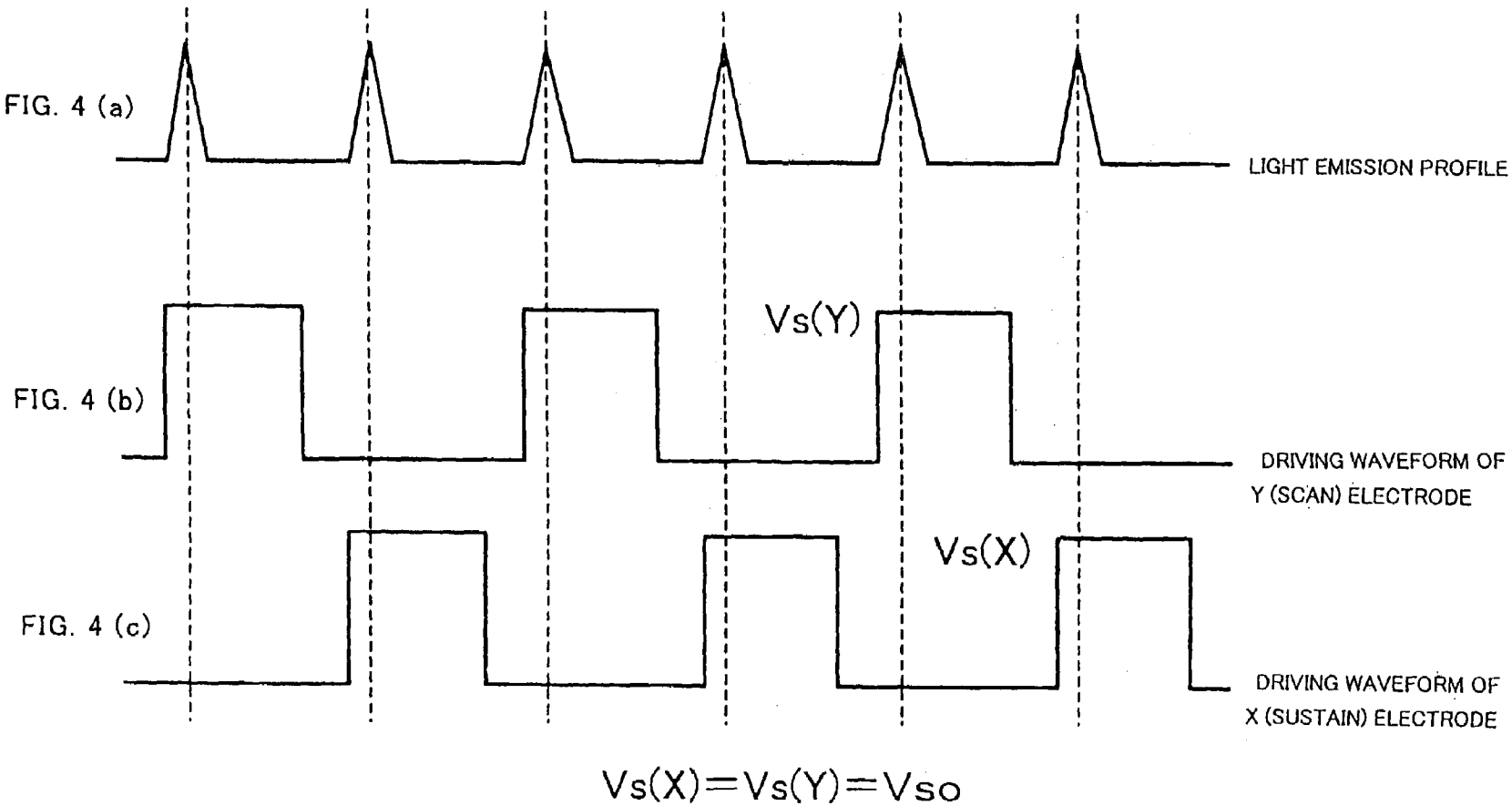
FIGS. 4(*a*), 4(*b*) and 4(*c*) illustrate conventional driving waveforms.

For comparison, conventional driving waveforms and light emission profile are shown in FIGS. 4(*a*), 4(*b*) and 4(*c*).

FIGS. 4(*a*) and 4(*b*) show the driving waveforms applied to the X electrode and the Y electrode, respectively, for generating the sustain discharge. FIG. 4(*c*) shows the light emission profile.

The sustain voltage Vs(X) applied to the sustain electrode (the X electrode) has the same crest value as that of the sustain voltage Vs(Y) applied to the scan electrode (the Y electrode), and the peak values in the light emission profile are all the same. If each of Vs(X) and Vs(Y) of this case is given as Vso, the following relationship is established among Vs(X), Vs(Y), of FIG. 3(*b*), and Vso:

$$Vs(X)<Vso<Vs(Y).$$

Typically, the relationship is substantially set as follows:

$$[Vs(X)+Vs(Y)]/2=Vso.$$

Embodiment 2

Figure 5:
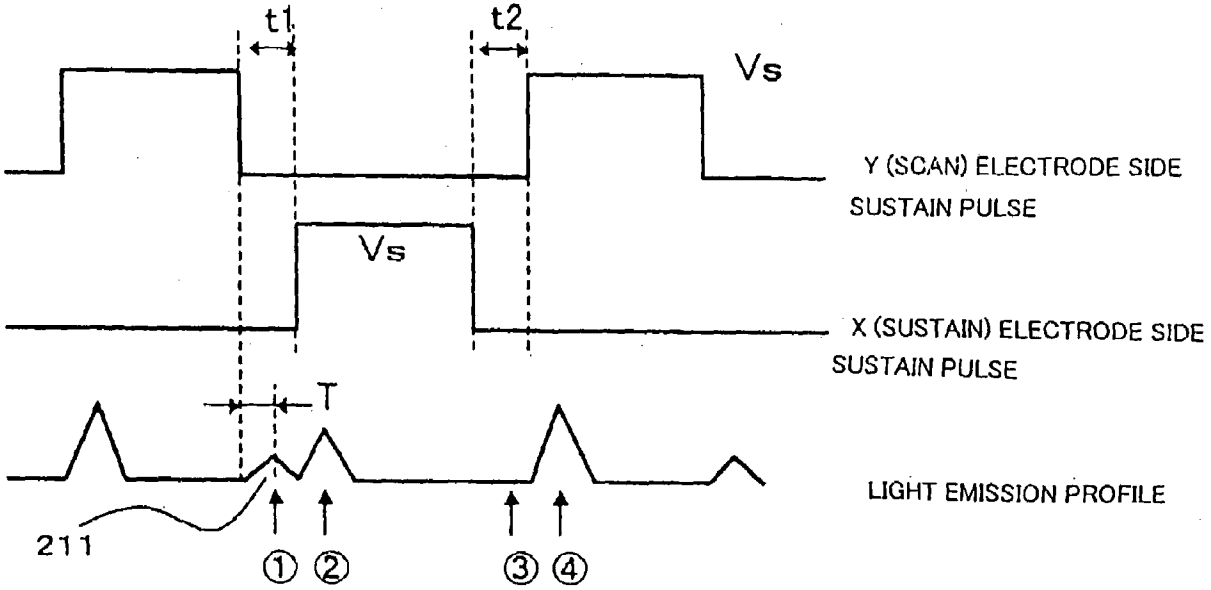
FIGS. 5(*a*) and 5(*b*) show driving waveforms and discharge states in a cell according to Embodiment 2, respectively.
Figure 5:
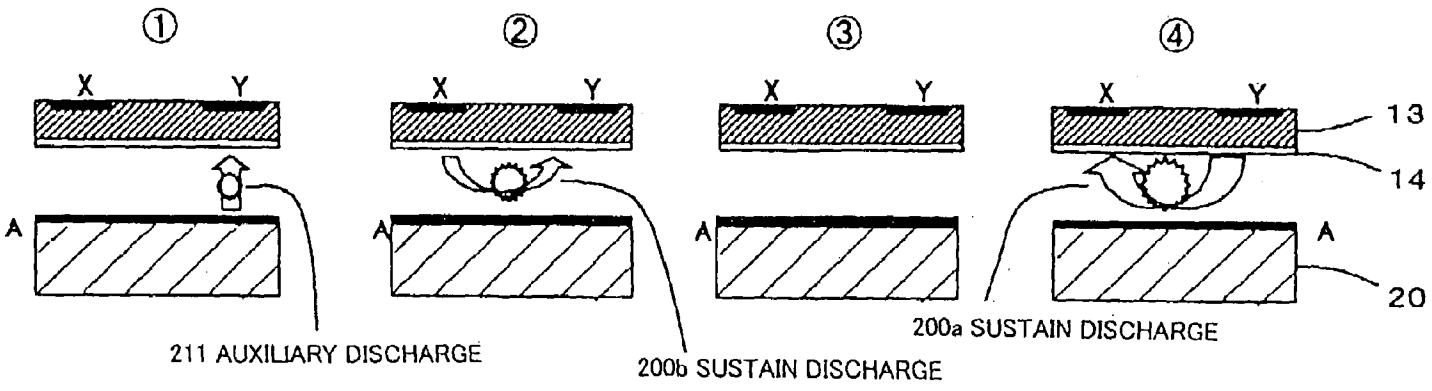

FIG. 5(*a*) shows driving waveforms and FIG. 5(*b*) shows discharge states in a cell, according to Embodiment 2.

In FIG. 5(*b*), the X electrode 11, Y electrode 12 and A electrode 21 of FIG. 10 are indicated by symbols X, Y and A, respectively.

FIG. 5(*b*) shows the discharge states in the cell in steps ①–④ that correspond to steps ①–④ of the light emission profile of FIG. 5(*a*). In FIG. 5(*b*), illustrations are omitted of the front substrate (the substrate having the X electrode and the Y electrode), the dielectric layer on the address electrode on the rear substrate, and phosphor above the address electrode.

A discharge intensity of a sustain discharge is greatly affected by an amount of electric charge accumulated in a cell at the time immediately before the sustain discharge. The accumulation of the amount of electric charge is completed at the end of the immediately preceding sustain discharge.

Ordinarily, in comparison between the sustain discharge in which the sustain electrode X serves as the anode and the sustain discharge in which the scan electrode Y serves as the anode, they are the same in the amount of charge accumulated in the cell after the respective sustain discharges.

In the present embodiment, on the other hand, the PDP is controlled such that after a sustain discharge 200*a* in which the scan electrode Y serves as the anode, an auxiliary discharge is generated between the scan electrode Y and address electrode A within the period during which the potential difference between the scan electrode Y and the sustain electrode X is zero (The controlling manner will be specified later). The auxiliary discharge is indicated by reference numeral 211 in FIGS. 5(*a*) and 5(*b*) (step ①). This auxiliary discharge 211 serves to reduce the amount of charge in a cell accumulated at end of the immediately preceding sustain discharge. Therefore, in a sustain discharge 200*b* (in step ② in FIGS. 5(*a*) and 5(*b*)) in which the sustain electrode X in turn serves as the anode, its instantaneous discharge intensity is lowered.

Also, the PDP is controlled such that after the sustain discharge 200*b* in step ②), the auxiliary discharge 211 does not occur within the period during which the potential difference between the scan electrode Y and the sustain electrode X is zero (The controlling manner will be specified later). This step is indicated by numeral reference ③ in FIGS. 5(*a*) and 5(*b*). The sustain discharge 200*a* in which the scan electrode Y in turn serves as the anode is generated in the same manner as ordinary sustain discharges. This step is indicated by numeral reference ④ in FIGS. 5(*a*) and 5(*b*).

As shown in FIG. 5(*b*), the auxiliary discharge 211 occurs from the address electrode A toward the Y electrode. In step ②, the sustain discharge 200*b*, smaller than ordinary discharges, occurs from the X electrode toward the Y electrode. In step ③, the auxiliary discharge 211 does not occur. Therefore, in step ④, the sustain discharge 200*a*, as large as ordinary discharges, occurs from the Y electrode toward the X electrode.

By thus controlling the sustain discharge (the surface discharge), it is possible to ease a damage to the portion of the protective layer on the scan electrode Y, thereby reducing variations in characteristics of the address discharge (the opposite discharge) between the scan electrode Y and the address electrode A. Also, average brightness of the panel can be maintained substantially at the same level as conventionally.

Now, the manner of driving PDP for generating the auxiliary discharge 211 in step ① will be specified.

There is a delay time from a moment at which the potential difference between the scan electrode Y and the sustain electrode X becomes zero to the beginning of an ordinary sustain discharge. This discharge delay time is given as T. The following relationship is established among discharge delay time T, time gaps t1 and t2 shown in FIG. 5(*a*):

$$t1>T>t2.$$

That is, t1 is set to a larger value than the value of discharge delay time T, and t2 is set to a smaller value than the value of discharge delay time T. By thus setting, it is possible to control the PDP such that the auxiliary discharge 211 occurs in step ① whereas it does not occur in step ②. More specifically, by giving a larger difference between t1 and t2 with t1 being greater than t2, it is possible to control the PDP with more certainty as to whether or not the auxiliary discharge 211 should occur.

In conventional driving waveforms as shown in FIGS. 4(*a*) and 4(*b*), the auxiliary discharge 211 does not occur since time gaps (i.e., time gaps each between sustain pulses) equivalent to t1 and t2 of FIG. 5(*a*) are both set to a smaller value than that of time lag T (Those time gaps are set to an extremely small value).

In this embodiment, the driving waveform, not shown, of the address electrode A is maintained typically at a ground level during the sustain discharge.

Embodiment 3

Referring to FIGS. 6(A), 6(B), 6(C) and 6(D), a driving method according to Embodiment 3 will be explained.

Figure 6:
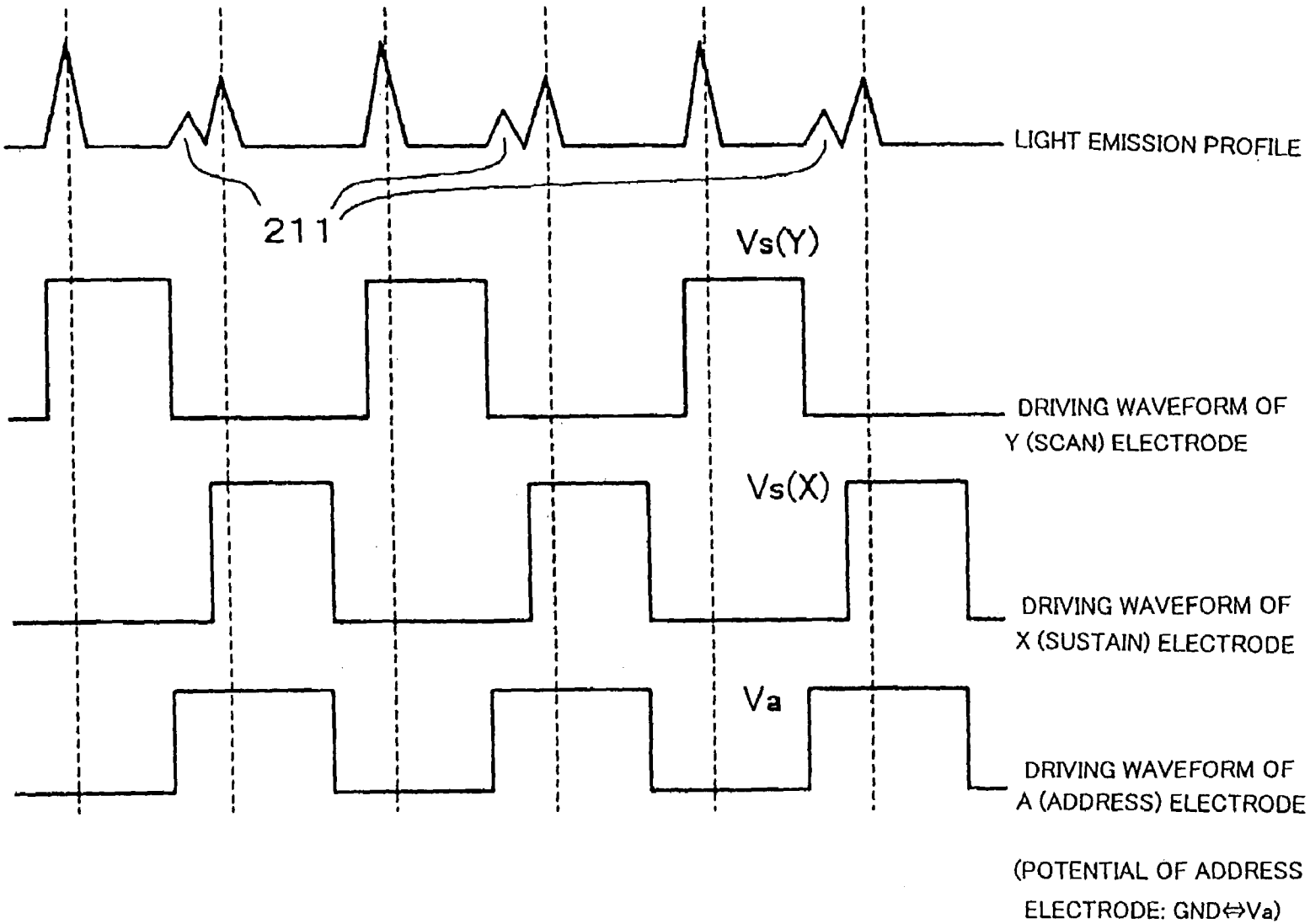
FIGS. 6(A), 6(B), 6(C) and 6(D) show light emission profile and driving waveforms according to Embodiment 3, respectively.

FIGS. 6(B), 6(C) and 6(D) show driving waveforms applied to the X electrode, the Y electrode and the A electrode, respectively, for generating the sustain discharge, and FIG. 6(A) shows the light emission profile.

This embodiment is the same as Embodiment 2 except for the driving waveform of the address electrode 21.

To the address electrode 21, an address voltage Va is applied during a period of occurrence of the auxiliary discharge 211 and during the period subsequent to that, and a voltage at a ground level (0V) is applied during the other periods. Thus, the voltage of positive charge is applied to the address electrode 21 when the auxiliary discharge 211 should occur for facilitating occurrence of the auxiliary discharge 211. This can be easily understood if reference is made to an orientation (a direction indicated by arrow) of the auxiliary discharge 211 shown in step ① in FIG. 5(*b*).

Embodiment 4

Referring to FIGS. 7(A), 7(B), 7(C) and 7(D), a driving method according to Embodiment 4 will be explained.

Figure 7:
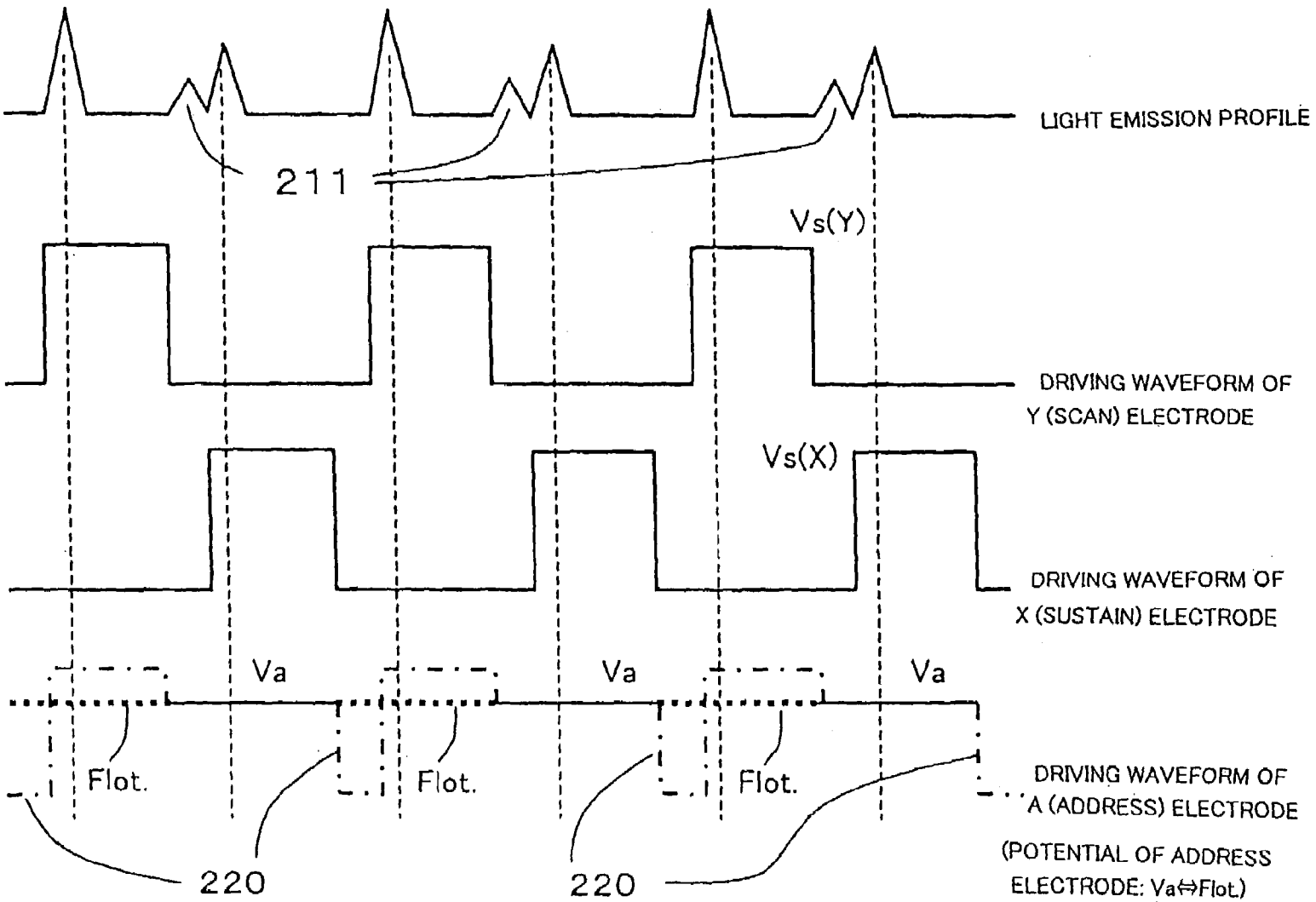
FIGS. 7(A), 7(B), 7(C) and 7(D) show light emission profile and driving waveforms according to Embodiment 4, respectively.

FIGS. 7(B), 7(C) and 7(D) show driving waveforms applied to the X electrode, the Y electrode and the A electrode, respectively, for generating the sustain discharge, and FIG. 7(A) shows the light emission profile.

This embodiment is the same as Embodiment 3 except for part of the driving waveform of the address electrode 21. In this embodiment, during the period of the application of the voltage Va, the address electrode 21 is set to the same state as in Embodiment 3. During the periods other than that period, however, the address electrode 21 is set to a floating state (This is the only difference between the present embodiment and Embodiment 3). The floating state is indicated by the dotted lines in FIG. 7(D). The address electrode 21 in the floating state has an effective voltage that varies as indicated by the dash-single dot lines (by reference numeral 220) in FIG. 7(D).

By thus driving the PDP, it is possible to generate the auxiliary discharge 211 when desired and to prevent the auxiliary discharge 211 from being generated when not desired.

The driving method of the present embodiment is advantageous in that it is more simplified than that of Embodiment 3.

Embodiment 5

Figure 8:
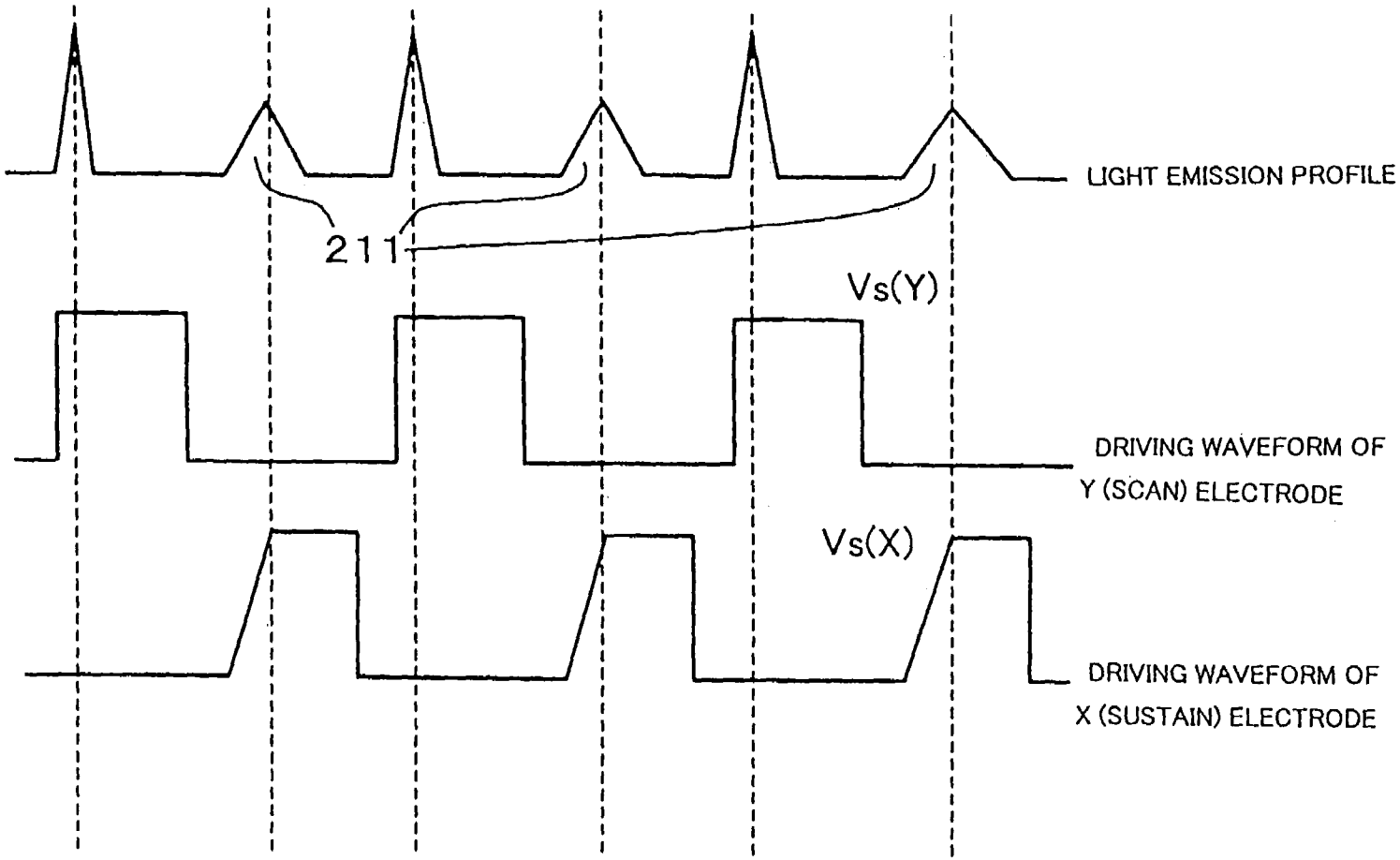
FIGS. 8(*a*), 8(*b*) and 8(*c*) show driving waveforms and light emission profile according to Embodiment 5, respectively.

Referring to FIGS. 8(*a*), 8(*b*) and 8(*c*), a driving method according to Embodiment 5 will be explained.

FIGS. 8(*a*), and 8(*b*) show driving waveforms applied to the X electrode and the Y electrode, respectively, for generating the sustain discharge, and FIG. 8(*c*) shows the light emission profile.

In this embodiment, as shown in FIG. 8(*b*), the driving waveform of the scan electrode 12 is the same as ordinarily. As shown in FIG. 8(*a*), the driving waveform applied to the sustain electrode X, however, has a longer pulse-rise-time. By thus driving the PDP, it is possible to reduce the discharge intensity of a sustain discharge in which the sustain electrode 11 serves as the anode to a smaller value than that of discharge intensity of a sustain discharge in which the scan electrode 12 serves as the anode.

By thus controlling the sustain discharge, it is possible to ease the damage to the portion of the protective layer on the scan electrode, thereby reducing variations with time in characteristics of the address discharge (the opposite discharge) between the scan electrode 12 and the address electrode 21.

Embodiment 6

Figure 9:
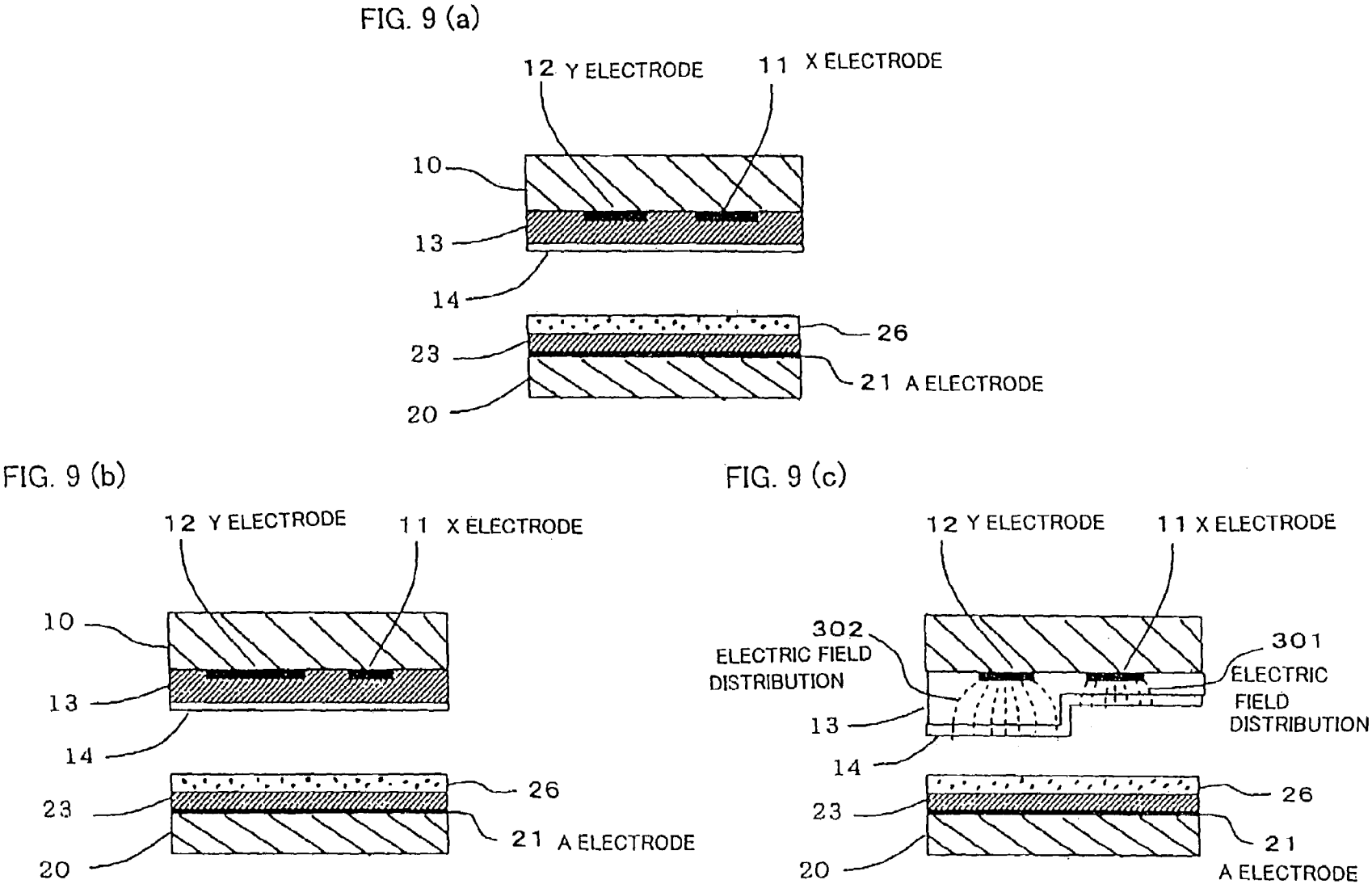
FIGS. 9(*a*), 9(*b*) and 9(*c*) show a conventional PDP, a plasma display panel according to Embodiment 6, and a plasma display panel according to Embodiment 7, respectively.

FIG. 9(*b*) shows a plasma display panel according to Embodiment 6. For comparison, FIG. 9(*a*) shows a cross sectional view of a conventional PDP.

In FIGS. 9(*a*) to 9(*c*), the X electrode 11 is shown as one electrode by combining together the transparent electrode 11*i* and the bus electrode 11*b* shown in FIG. 10, and the same holds for the Y electrode 12 in FIGS. 9(*a*) to 9(*c*).

In FIGS. 9(*a*) to 9(*c*), the positional relationship between the X electrode 11 and the Y electrode 12 is the reverse of that shown in, for example, FIGS. 1(*a*) and 1(*b*). Names, X electrode 11 and Y electrode 12 are given, however, depending on the function of the electrode concerned as to whether the electrode should be regarded as the X electrode (the sustain electrode) or the Y electrode (the scan electrode) shown in, for example, FIGS. 12(*a*) to 12(*c*) (The reversal of left to right has no particular meaning).

FIG. 9(*b*) shows the construction of a PDP where the scan electrode 12 has a larger area than that of the sustain electrode 11. For example, the transparent electrode of the scan electrode 12 is set to a width of 200 μm and the transparent electrode of the sustain electrode 11 is set to a width of 100 μm, so that the former is set to twice the width that of the latter.

A discharge intensity per unit area decreases with increase of an area of an electrode. In the panel structure shown in FIG. 9(*b*), therefore, a discharge intensity per unit area of a sustain discharge in which the sustain electrode 11 serves as the anode can be smaller than one in a sustain discharge in which the scan electrode 12 serves as the anode.

By thus constituting the PDP, it is possible to ease the damage to the portion of the protective layer on the scan electrode, thereby reducing variations with time in characteristics of the address discharge (opposite discharge) between the scan electrode 12 and the address electrode 21.

Embodiment 7

FIG. 9(*c*) shows a plasma display panel according to Embodiment 7.

This PDP has a structure where a portion of the dielectric layer on the scan electrode 12 is thicker than a portion of the dielectric layer on the sustain electrode 11. For example, the former is set to a thickness of 40 μm and the latter is set to a thickness of 20 μm, so that the former is set to twice the thickness of the latter.

As shown in FIG. 9(*c*), distributions 301 and 302 of electrical field (of line of electric force) are provided in correspondence with the thickness of the dielectric layer. With the dielectric layer being thicker, the electric field distribution 302 covers a larger area of a surface of the protective layer, whereas with the dielectric layer being thinner, the electric field distribution 301 covers a smaller area of the surface of the protective layer. Thus, increase of the thickness of the dielectric layer corresponds to increase of the effective area of an electrode.

Thereby, in the PDP shown in FIG. 9(*c*), the "discharge intensity per unit area" of the sustain discharge in which the scan electrode 12 serves as the cathode is reduced to a lower value as is the case of the PDP shown in FIG. 9(*b*) (i.e., the PDP where the area of the scan electrode 12 is greater than that of the sustain electrode 11). As a result, it is possible to ease the damage to the protective layer, thereby reducing variations with time in characteristics of the address discharge (opposite discharge) between the scan electrode 12 and the address electrode 21.

In the sustain discharge in which the scan electrode 12 serves the cathode, positive ions collide against the dielectric layer (including the protective layer 14 formed on its surface) at its thicker portion to generate a higher wall voltage. This wall voltage serves to attenuate the velocity of the subsequent positive ions coming into collision with the surface of the protective layer 14 to relive impact of the positive ions' collision on that surface during the sustain discharge. This makes it possible to ease the damage to the protective layer, thereby reducing variations with time in characteristics of the address discharge (opposite discharge) between the scan electrode 12 and the address electrode 21.

In view of both the distribution of electric field and the wall voltage, it is appropriate to consider the "thickness of the dielectric layer" as including the thickness of the protective layer 14. For this reason, the "dielectric layer" here means one including the "protective layer" formed thereon. Thus, if the protective layer 14 is changed in thickness, the dielectric layer can be also changed in thickness.

Embodiment 8

Referring to FIGS. 15(*a*1), 15(*a*2), 15(*b*1), 15(*b*2), 15(*c*1), 15(*c*2), 15(*d*1), 15(*d*2), a driving method according to Embodiment 8 will be explained.

In these drawings, symbols X, Y and A indicates driving waveforms applied to the X electrode, the Y electrode and the A electrode, respectively, and symbol L indicates the light emission profile.

In the driving methods according to Embodiments 1–5, the sustain discharges have at least two discharge intensity values such that the discharge intensity of the sustain discharge in which the X electrode serves as the anode is always smaller than the discharge intensity of the sustain discharge in which the Y electrode serves as the anode.

According to the present embodiment, on the other hand, the PDP is driven such that the relationship of the discharge intensity values between a case where the X electrode serves as the anode and a case where the Y electrode serves as the anode is periodically inverted (i.e., the driving waveforms are changed periodically between the X electrode and the Y electrode) as shown in FIGS. 15(*a*1), 15(*a*2), 15(*b*1), 15(*b*2), 15(*c*1), 15(*c*2), 15(*d*1), 15(*d*2).

For example, the driving waveforms according to Embodiment 1 (FIGS. 3(*a*) and 3(*b*)) are changed periodically between the X electrode and the Y electrode. That is, a combination of driving waveforms according to Embodiment 1 (FIGS. 3(*a*) and 3(*b*)) shown in FIG. 15(*a*1) and a combination of driving waveforms shown in FIG. 15(*a*2) are employed by turns periodically. The combination of driving waveforms of FIG. 15(*a*2) is obtained by changing the driving waveforms of FIG. 15(*a*1) between the X electrode and the Y electrode. As a result, referring to the light emission profiles L, the emission intensity (i.e., the discharge intensity) obtained when, for example, the X electrode serves as the anode, is a smaller in a case of FIG. 15(*a*1), whereas it is larger in a case of FIG. 15(*a*2). By thus alternating the case of FIG. 15(*a*1) and the case of FIG. 15(*a*2), the values large and small of the emission intensity (i.e., the discharge intensity) are also changed periodically.

In correspondence to Embodiment 3, the driving method according to the present embodiment is used-as follows: A combination of driving waveforms shown in FIG. 15(*b*1) of Embodiment 3 and a combination of driving waveforms shown in FIG. 15(*b*2) are employed by turns periodically. The combination of waveforms of FIG. 15(*b*2) is obtained by changing the driving waveforms of FIG. 15(*b*1) between the X electrode and the Y electrode.

In correspondence to Embodiment 2, the driving method according to the present embodiment is used as follows (illustration omitted): The driving waveform of the A electrode of FIGS. 15(*b*1) and 15(*b*2) is maintained at a ground level.

In correspondence to Embodiment 4 and 5, the driving method according to the present embodiment is used as follows: a combination of waveforms of FIG. 15(*c*1) and a combination of waveforms of FIG. 15(*c*2) are employed by turns periodically, as well as a combination of waveforms of FIG. 15(*d*1) and a combination of waveforms of FIG. 15(*d*2) are employed by turns periodically.

The driving method of the present embodiment of FIGS. 15(*a*1), 15(*a*2), 15(*b*1), 15(*b*2), 15(*c*1), 15(*c*2), 15(*d*1), 15(*d*2), is advantageous over those of Embodiments 1–5 in the following points: there is a diminished but still available effect of easing the damage to the surface of the protective layer (i.e., the damage can be reduced to a smaller degree than ordinarily). Moreover, the damage to the protective layer surface can be even between the portion thereof on the X electrode and the portion thereof on the Y electrode.

It is found that, when the instantaneous discharge intensity of a sustain discharge is decreased below a predetermined value, the damage to the protective layer is significantly eased. Therefore, when the instantaneous discharge intensity of the sustain discharge in which the scan electrode serves as the cathode is decreased below the predetermined value, the reduction rate in damage to the portion of the protective layer on the scan electrode exceeds the increase rate in damage to the portion of on the sustain electrode. Therefore, also by changing the values large and small of the instantaneous discharge intensity periodically, it is possible to ease the damage to be caused with time to the protective layer in general.

According to Embodiments 1–5, mainly the portion of the protective layer on the sustain electrode is sputtered progressively. It is possible to sputter the portion of the protective layer on the sustain electrode and the portion on the scan electrode substantially uniformly by changing the values large and small of the instantaneous discharge intensity periodically. Thus, compared with Embodiments 1–5 where mainly the portion of the protective layer on the sustain electrode is sputtered, Embodiment 8 is advantageous in that the life of a PDP can be expected to be prolonged, which otherwise may be shortened due to "exhaustion of the protective layer".

Figure 11:
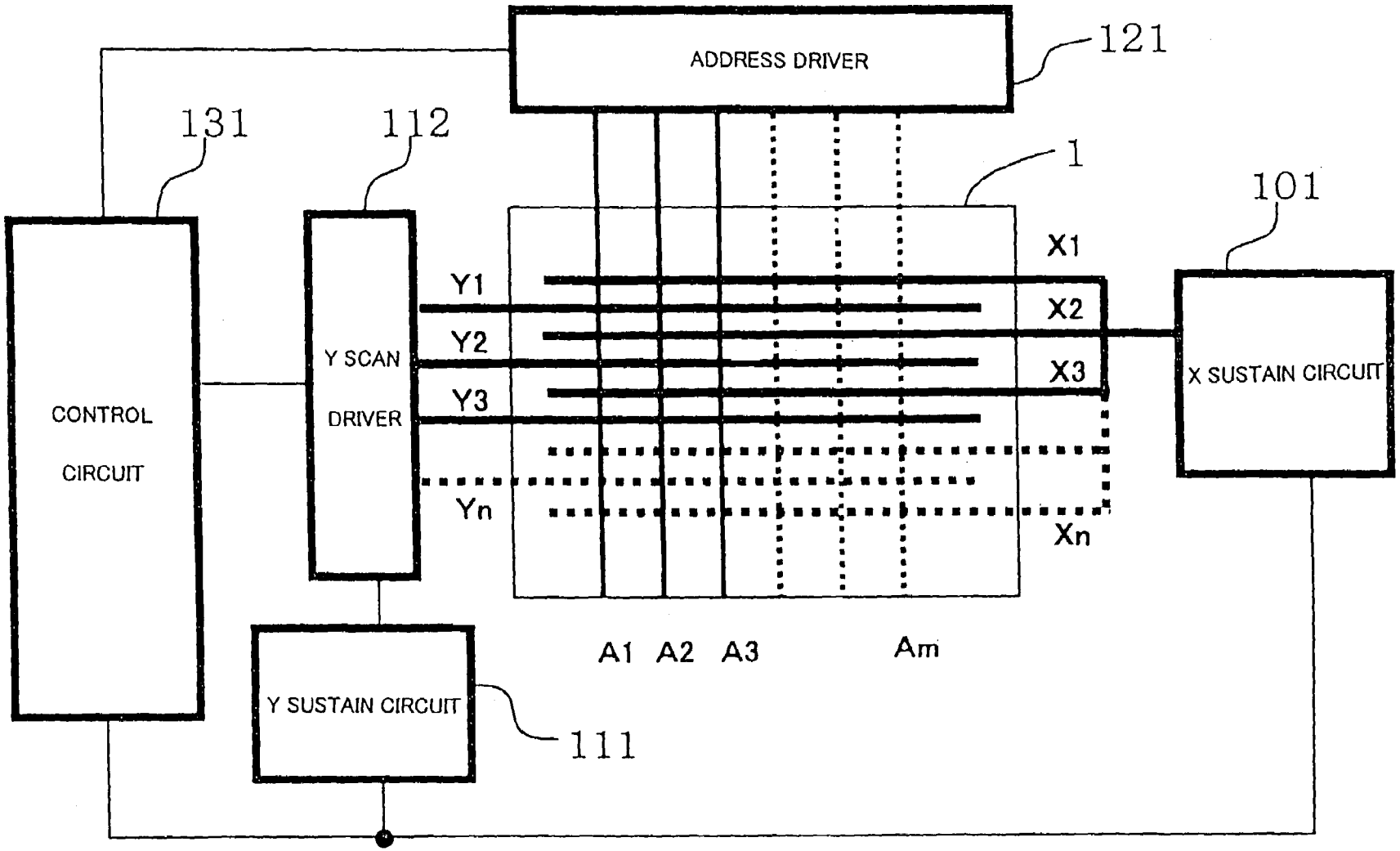
FIG. 11 is a view illustrating an example of the construction of a plasma display panel device.
Figure 12:
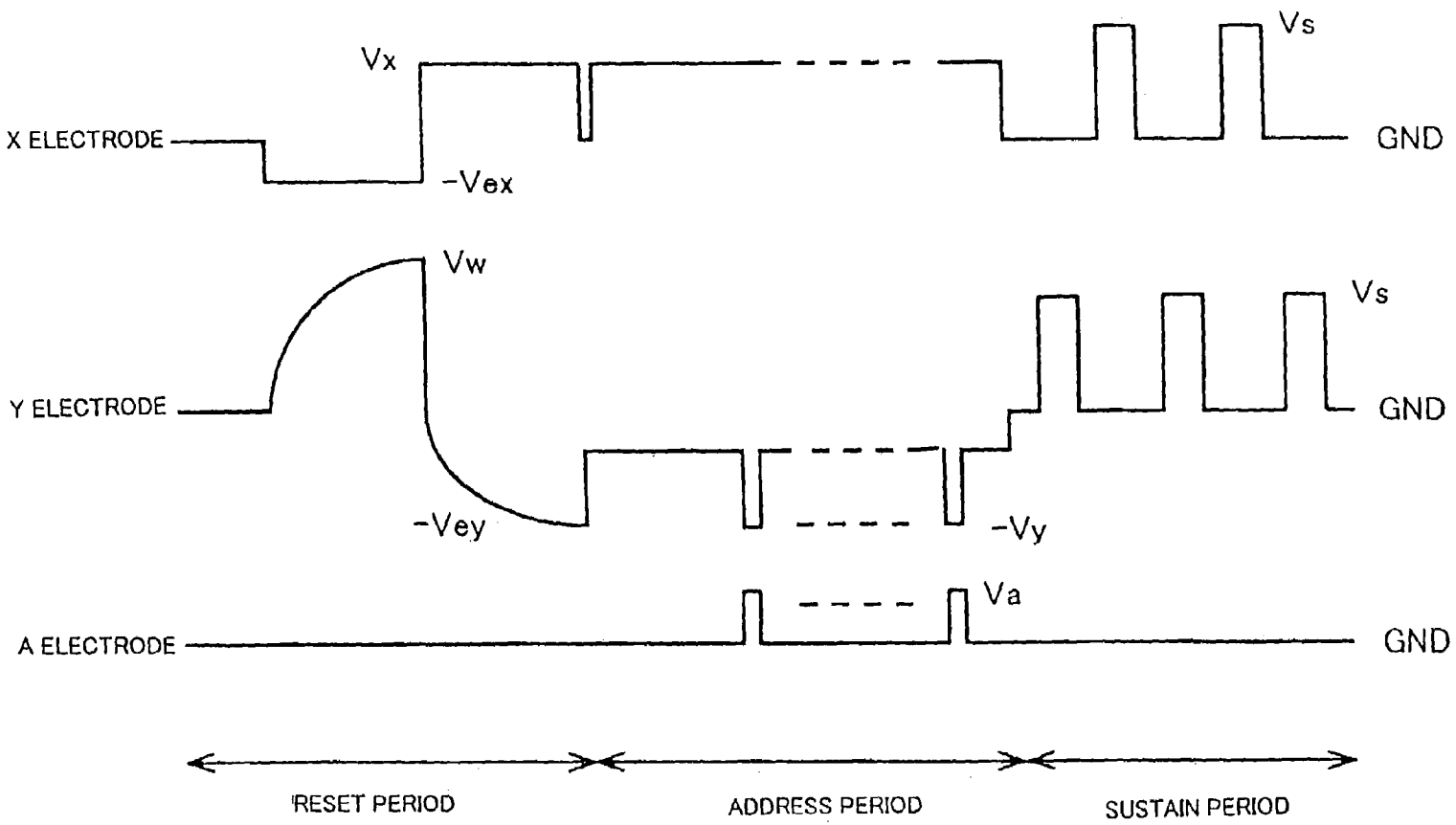
FIGS. 12(*a*), 12(*b*) and 12(*c*) are views illustrating examples of driving waveforms.
Figure 13:
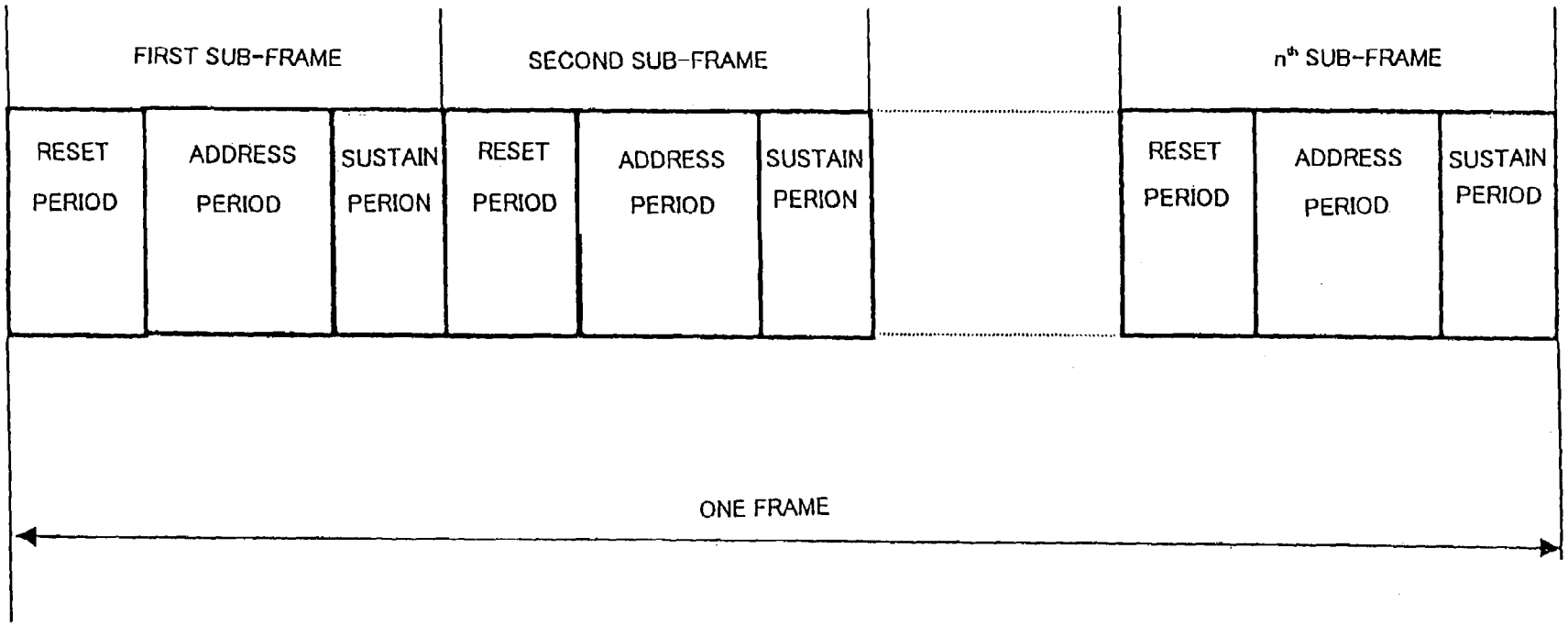
FIG. 13 is a view illustrating an example of the constitution of a frame.
Figure 14:
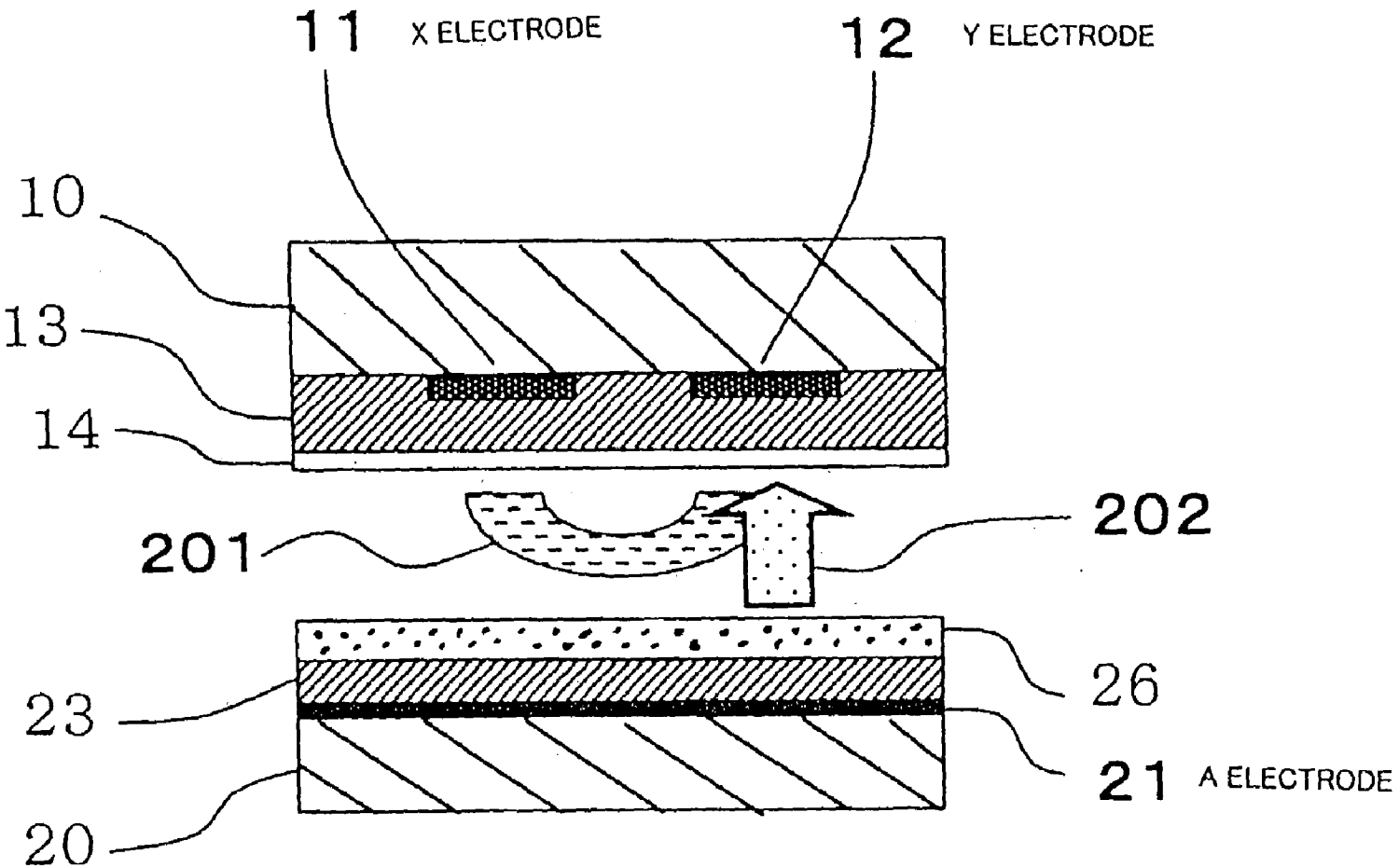
FIG. 14 is a schematic view illustrating a sustain discharge and an address discharge.

Embodiments 1–8 as mentioned above are applied to the PDP of a type shown in FIGS. 10, 11, 12(*a*)–12(*c*) and 13 (a type widely used in the field of PDPs) and to the method of driving it. Embodiments 1–8 can be also applied to a PDP of another type described in Japanese Unexamined Patent Publication No. Hei 9(1997)-160525 (a type commonly called ALIS) and to a method of driving it.

According to the plasma display panel and the method of driving it of the first and second groups of inventions, it is possible to ease the damage to be caused especially to the portion of the protective layer on the scan electrode, thereby reducing deterioration in operating margin of a plasma display panel device, the deterioration being caused with time by variations with time in characteristics of a protective layer surface of the plasma display panel.

The invention claimed is:

1. A method of driving a plasma display panel which includes a plurality of first electrodes formed on a substrate, a plurality of second electrodes, a plurality of third electrodes formed in a direction intersecting the first electrodes and the second electrodes, and a dielectric layer covering the first electrodes and the second electrodes and having a protective layer on a surface of the dielectric layer, the method comprising:

generating an address discharge between the first electrode and the third electrode to select a predetermined cell and sustain discharges between the first electrode and the second electrode to produce light for display; and controlling the plasma display panel such that the discharge intensity of a sustain discharge in which the second electrode serves as the anode is smaller than the discharge intensity of a sustain discharge in which the first electrode serves as the anode.

2. A method of driving a plasma display panel by operations of an address period and a sustain period, the panel comprising a plurality of discharge cells each including first and second electrodes for sustaining a surface discharge between the first and second electrodes and a third electrode for addressing, the address period and the sustain period being separated in terms of time, the method comprising:

selectively applying, in the address period, an address voltage pulse between the first and third electrodes such that a first electrode side is negative; and alternately applying, in the sustain period, a first sustain voltage pulse between the first and second electrodes such that a first electrode side is positive and a second electrode side is negative and a second sustain voltage pulse between the first and second electrodes such that a second electrode side is positive and a first electrode side is negative, the second sustain voltage pulse being smaller in voltage than the first sustain voltage pulse.

3. A method of driving a plasma display panel by operations of an address period and a sustain period, the panel comprising a plurality of discharge cells each including first and second electrodes for sustaining a surface discharge between the first and second electrodes and a third electrode for addressing, the address period and the sustain period being separated in terms of time, the method comprising:

selectively applying, in the address period, an address voltage pulse between the first and third electrodes such that a first electrode side is negative; and alternately applying, in the sustain period, a first sustain voltage pulse between the first and second electrodes such a first electrode side is positive and a second electrode side is negative and a second sustain voltage pulse between the first and second electrodes such that a second electrode side is positive and a first electrode side is negative, the second sustain voltage pulse being longer in rise-time than the first sustain voltage pulse.

4. A display device for driving a plasma display panel by operations of an address period and a sustain period, the panel comprising a plurality of discharge cells each including first and second electrodes for sustaining a surface discharge between the first and second electrodes and a third electrode for addressing, the address period and the sustain period being separated in terms of time, the device comprising:

a scan driver for sequentially scanning the first electrodes in the address period;

an address driver for selectively applying a positive address pulse to the third electrode in the address period; and a sustain circuit for alternately applying first and second sustain voltage pulses having different voltage waveforms to the first and second electrodes in the sustain period, wherein the sustain circuit alternately outputs the first sustain voltage pulse between the first and second electrodes such that a first electrode side is positive and a second electrode side is negative and the second sustain voltage pulse between the first and second electrodes such that a second electrode side is positive and a first electrode side is negative, the first and second sustain voltage pulses being different in voltage or rise-time so that the second sustain voltage pulse generates a smaller discharge than a discharge generated by the first sustain voltage pulse.

5. An apparatus comprising:

a plasma display panel comprising a plurality of discharge cells each including first and second electrodes for sustaining a surface discharge between the first and second electrodes and a third electrode for addressing; and means for driving the plasma display panel via an address period and a sustain period separated in terms of time, said means for driving including means for selectively applying, in the address period, an address voltage pulse between the first and third electrodes such that a first electrode side is negative, and means for alternately applying, in the sustain period, a first sustain voltage pulse between the first and second electrodes such that a first electrode side is positive and a second electrode side is negative and a second sustain voltage pulse between the first and second electrodes such that a second electrode side is positive and a first electrode side is negative, the second sustain voltage pulse being smaller in voltage than the first sustain voltage pulse.

* * * * *